US011049444B2

(12) United States Patent
Kim et al.

(10) Patent No.: US 11,049,444 B2
(45) Date of Patent: Jun. 29, 2021

(54) DISPLAY DEVICE AND DRIVING METHOD THEREOF

(71) Applicant: Samsung Display Co., Ltd., Yongin-si (KR)

(72) Inventors: Jong Wook Kim, Yongin-si (KR); Eun Zi Kim, Yongin-si (KR); Byoung Kwan An, Yongin-si (KR); Seung Ho Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/820,433

(22) Filed: Mar. 16, 2020

(65) Prior Publication Data

US 2020/0312235 A1 Oct. 1, 2020

(30) Foreign Application Priority Data

Mar. 28, 2019 (KR) ..... 10-2019-0036255

(51) Int. Cl.
*G09G 3/3208* (2016.01)
*G09G 3/3225* (2016.01)
*G09G 3/3275* (2016.01)

(52) U.S. Cl.
CPC ..... *G09G 3/3208* (2013.01); *G09G 3/3225* (2013.01); *G09G 3/3275* (2013.01); *G09G 2320/029* (2013.01); *G09G 2320/04* (2013.01); *G09G 2320/041* (2013.01)

(58) Field of Classification Search
CPC .. G09G 3/3208; G09G 3/3225; G09G 3/3275; G09G 2320/029; G09G 2320/04; G09G 2320/041; G09G 2320/043; G09G 2320/045
USPC ..... 345/76–78, 690
See application file for complete search history.

(56) References Cited

U.S. PATENT DOCUMENTS

| | | | | |
|---|---|---|---|---|
| 9,384,696 | B2 | 7/2016 | Okuno et al. | |
| 9,620,058 | B2 | 4/2017 | Lee | |
| 10,096,300 | B2 | 10/2018 | Cheon et al. | |
| 10,127,857 | B2 | 11/2018 | Lee et al. | |
| 2016/0133172 | A1* | 5/2016 | Hwang | G09G 3/3233 324/762.07 |
| 2017/0032723 | A1 | 2/2017 | Kim et al. | |
| 2017/0053587 | A1* | 2/2017 | Kim | G09G 3/2092 |
| 2017/0213493 | A1* | 7/2017 | Han | G09G 3/3208 |

FOREIGN PATENT DOCUMENTS

| | | | |
|---|---|---|---|
| JP | 5106005 | B2 | 12/2012 |
| KR | 10-2015-0019025 | A | 2/2015 |
| KR | 10-2015-0062968 | A | 6/2015 |

(Continued)

*Primary Examiner* — Jimmy H Nguyen
(74) *Attorney, Agent, or Firm* — Lewis Roca Rothgerber Christie LLP

(57) ABSTRACT

A display device includes: a display panel including a plurality of pixels configured to receive pixel driving currents; a current sensor configured to measure an entire driving current diverged into the pixel driving currents; and a temperature sensor configured to measure an ambient temperature of the display panel, wherein the display panel includes a degradation compensator configured to generate output grayscale values for the pixels based on the entire driving current, the ambient temperature, and input grayscale values for the pixels.

19 Claims, 6 Drawing Sheets

(56) References Cited

FOREIGN PATENT DOCUMENTS

| | | | |
|---|---|---|---|
| KR | 10-2017-0015582 | A | 2/2017 |
| KR | 10-2017-0087559 | A | 7/2017 |
| KR | 10-2017-0097253 | A | 8/2017 |
| KR | 10-2018-0002099 | A | 1/2018 |

* cited by examiner

DISPLAY DEVICE AND DRIVING METHOD THEREOF

CROSS-REFERENCE TO RELATED APPLICATION

This application claims priority to and the benefit of Korean Patent Application No. 10-2019-0036255 filed in the Korean Intellectual Property Office on Mar. 28, 2019, the entire contents of which are incorporated herein by reference.

BACKGROUND

1. Field

Aspects of some example embodiments of the present invention relate to a display device and a driving method thereof.

2. Description of the Related Art

As an information technology is developed, an importance of a display device, which is a connection medium between users and information, has been highlighted. Therefore, a display device such as a liquid crystal display device, an organic light emitting diode display device, and a plasma display device has been increasingly used.

Each pixel of the organic light emitting diode display may include at least one organic light emitting diode. The organic light emitting diode may degrade as a usage time increases, requiring more driving current to exhibit the same luminance.

The above information disclosed in this Background section is only for enhancement of understanding of the background and therefore the information discussed in this Background section does not necessarily constitute prior art.

SUMMARY

Some example embodiments of the present invention include a display device that may more accurately compensate for a degradation of an organic light emitting diode using a current sensor and a temperature sensor as well as input grayscale values of pixels and a driving method thereof.

A display device according to some example embodiments of the present invention includes a display panel including pixels receiving pixel driving currents; a current sensor for measuring an entire driving current diverged into the pixel driving currents; and a temperature sensor for measuring an ambient temperature of the display panel, wherein the display panel includes a degradation compensator that generates output grayscale values for the pixels based on the entire driving current, the ambient temperature, and input grayscale values for the pixels.

According to some example embodiments, the pixels may be set into blocks, a number of the blocks may be less than or equal to a number of the pixels, and the degradation compensator may include a block degradation value accumulator that accumulates a block degradation value based on the input grayscale values and a first block temperature to generate a block degradation accumulation value, for each of the blocks.

According to some example embodiments, the block degradation value accumulator may update the block degradation accumulation value by multiplying a first block representative value of the input grayscale values and the first block temperature to generate the block degradation value and adding the generated block degradation value to the block degradation accumulation value, for each of the blocks.

According to some example embodiments, the degradation compensator may further include a block representative value extractor that extracts a second block representative value based on a first block degradation accumulation value, which is the block degradation accumulation value at a first time, a second block degradation accumulation value, which is the degradation accumulation value at a second time, and a second block temperature, for each of the blocks.

According to some example embodiments, the block representative value extractor may divide a difference between the second block degradation accumulation value and the first block degradation accumulation value by the second block temperature to generate the second block representative value, for each of the blocks.

According to some example embodiments, the degradation compensator may further include a block current calculator that calculates a block current based on the entire driving current, the second block representative value, and an entire block representative value, for each of the blocks.

According to some example embodiments, the block current calculator may calculate the block current so that a ratio of the block current of the entire driving current corresponds to a ratio of the second block representative value of the entire block representative value, for each of the blocks.

According to some example embodiments, the degradation compensator may further include a block temperature determiner that determines the first block temperature based on the block current and the ambient temperature, for each of the blocks.

According to some example embodiments, the block temperature determiner may determine the first block temperature by adding a value proportional to a difference between a block predicted temperature for the block current and the ambient temperature to the ambient temperature, for each block.

According to some example embodiments, the degradation compensator may further include a grayscale converter that converts the input grayscale values to the output grayscale values based on the block degradation accumulation value.

According to some example embodiments, the grayscale converter may generate the output grayscale values by adding compensation values to the input grayscale values, and the compensation values are larger as the block degradation accumulation value corresponding to the compensation values is larger.

A driving method of a display device according to some example embodiments of the present invention includes: measuring a current that measures an entire driving current provided to a display panel and diverged into pixel driving currents; measuring a temperature that measures an ambient temperature of the display panel; and compensating a degradation that generates output grayscale values for the pixels based on the entire driving current, the ambient temperature, and input grayscale values for the pixels.

According to some example embodiments, the pixels may be set into blocks, a number of the blocks may be less than or equal to a number of the pixels, the compensating the degradation may include accumulating a block degradation value that accumulates a block degradation value based on the input grayscale values and a first block temperature to generate a block degradation accumulation value for each of the blocks, and the block degradation value is generated by multiplying a first block representative value of the input grayscale values and the first block temperature, and the block degradation accumulation value is updated by adding the generated block degradation value to the block degradation accumulation value for each of the blocks in the accumulating a block degradation value.

According to some example embodiments, the compensating the degradation may further include extracting a block representative value that extracts a second block representative value based on a first block degradation accumulation value, which is the block degradation accumulation value at a first time, a second block degradation accumulation value, which is the degradation accumulation value at a second time, and a second block temperature for each of the blocks, and the second block representative value is generated by dividing a difference between the second block degradation accumulation value and the first block degradation accumulation value by the second block temperature for each of the blocks in the extracting a block representative value.

According to some example embodiments, the compensating the degradation may further include calculating a block current that calculates a block current based on the entire driving current, the second block representative value, and an entire block representative value for each of the blocks.

According to some example embodiments, the block current may be calculated so that a ratio of the block current of the entire driving current corresponds to a ratio of the second block representative value of the entire block representative value for each of the blocks in the calculating a block current.

According to some example embodiments, the compensating the degradation may further include determining a block temperature that determines the first block temperature based on the block current and the ambient temperature for each of the blocks.

According to some example embodiments, the first block temperature may be determined by adding a value proportional to a difference between a block predicted temperature for the block current and the ambient temperature to the ambient temperature for each block in the determining a block temperature.

According to some example embodiments, the compensating the degradation may further include converting a grayscale that converts the input grayscale values to the output grayscale values based on the block degradation accumulation value.

According to some example embodiments, the output grayscale values may be generated by adding compensation values to the input grayscale values in the converting a grayscale, and the compensation values are larger as the block degradation accumulation value corresponding to the compensation values is larger.

A display device and a driving method thereof according to some example embodiments of the present invention can more accurately compensate for a degradation of an organic light emitting diode using a current sensor and a temperature sensor as well as input grayscale values of pixels.

DETAILED DESCRIPTION

Figure 1:
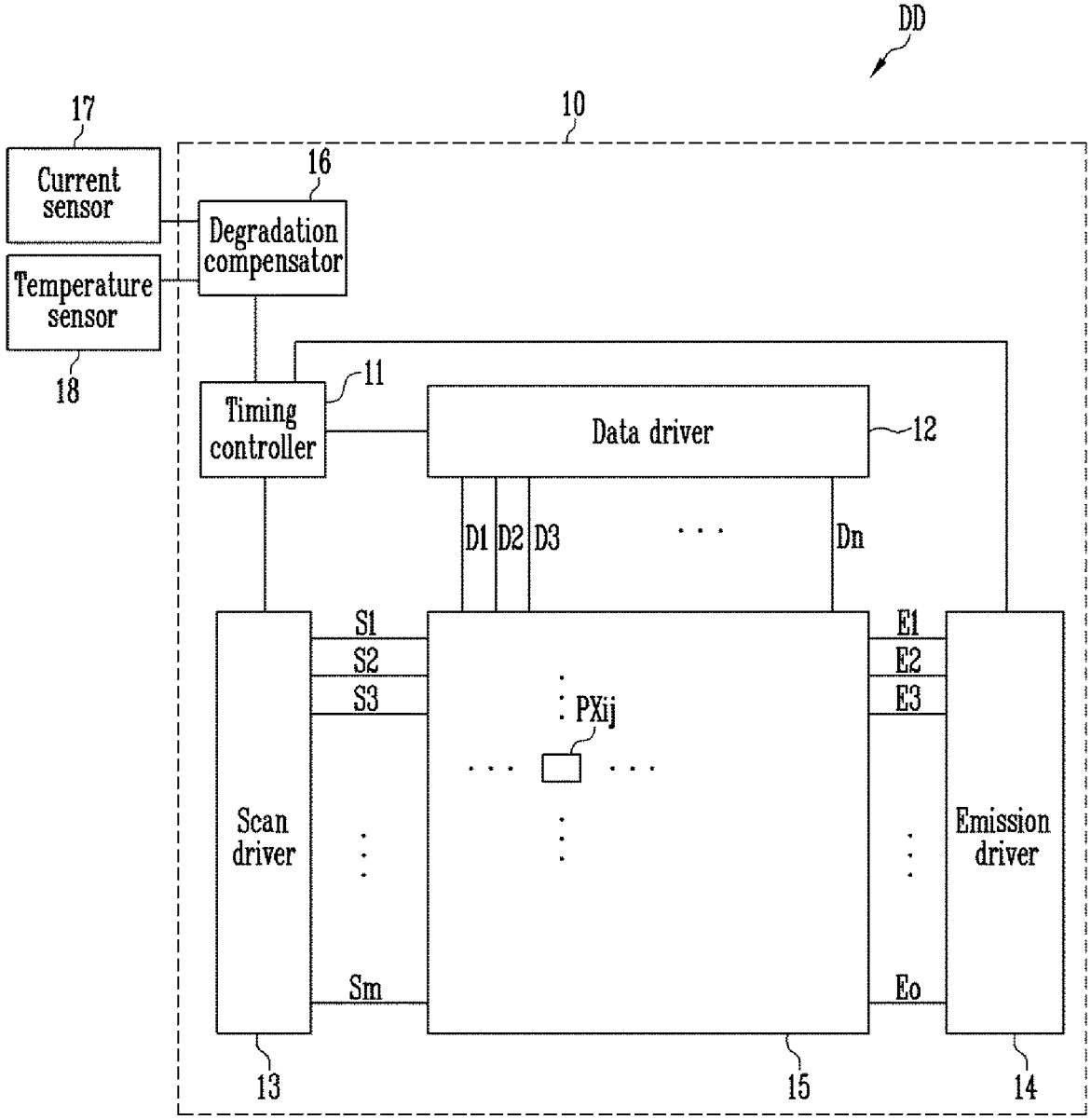
FIG. 1 is a drawing for illustrating a display device according to some example embodiments of the present invention.

Hereinafter, with reference to accompanying drawings, various example embodiments of the present invention will be described in more detail so that those skilled in the art can more easily carry out the present invention. The present invention may be embodied in many different forms and is not limited to the example embodiments described herein.

In order to more clearly illustrate example embodiments of the present invention, parts that are not related to the description are omitted, and the same or similar constituent elements are given the same reference numerals throughout the specification. Therefore, the above-mentioned reference numerals can be used in other drawings.

In addition, because the size and thickness of each configuration shown in the drawing are arbitrarily shown for better understanding and ease of description, example embodiments of the present invention are not necessarily limited to the illustrated one. In the drawings, the dimensions of layers and regions are exaggerated for clarity of illustration.

FIG. 1 is a drawing for illustrating a display device according to some example embodiments of the present invention.

Referring to FIG. 1, a display device DD according to some example embodiments of the present invention includes a display panel 10, a current sensor 17, and a temperature sensor 18. The display panel 10 may include a timing controller 11, a data driver 12, a scan driver 13, a emission driver 14, a pixel unit 15, and a degradation compensator 16.

The display panel 10 may include pixels PXij receiving pixel driving currents. The pixel driving current of each pixel PXij may determine a light emitting luminance of an organic light emitting diode included in each pixel PXij.

The current sensor 17 may measure an entire driving current that diverges into pixel driving currents. The entire driving current may refer to an entire current flowing from a first power line to a second power line in the pixel unit 15 (see FIGS. 2 and 4). According to some example embodiments, the current sensor 17 may be disposed to directly measure the entire current flowing from the first power line to the second power line.

According to some example embodiments, when it is not possible to dispose the current sensor 17 to directly measure the entire current flowing from the first power line to the second power line, the current sensor 17 may be disposed to measure a current provided to the pixel unit 15 or a current provided to an entire display panel 10. Because most of power of the display panel 10 is consumed in the pixel unit 15, the current sensor 17 may indirectly measure the entire driving current. That is, example embodiments of the present invention may be implemented with only one current sensor 17.

The temperature sensor 18 may measure an ambient temperature of the display panel. That is, example embodiments of the present invention may be implemented with only one temperature sensor 18.

The timing controller 11 may receive grayscale values and control signals for an image frame from an external processor. The timing controller 11 may render grayscale values corresponding to a specification of display device 10. For example, the external processor may provide a red grayscale value, a green grayscale value, and a blue grayscale value for each unit dot. However, for example, when the pixel unit 15 is a pentile structure, adjacent unit dots share pixels, so that each grayscale value may not correspond to one pixel. In this case, a rendering of grayscale values is required. When one grayscale value corresponds to one pixel, a rendering of grayscale values may be unnecessary. Grayscale values that are rendered or not rendered may be provided to the degradation compensator 16 as input grayscale values. In addition, the timing controller 11 may provide control signals suitable for each of the data driver 12, the scan driver 13, the emission driver 14, and the degradation compensator 16, and the like for displaying the image frame.

The degradation compensator 16 may generate output grayscale values for the pixels PXij based on the entire driving current, the ambient temperature and input grayscale values for the pixels PXij. The degradation compensator 16 may provide the generated output grayscale values directly to the data driver 12 or indirectly to the data driver 12 through the timing controller 11. A detailed description of the degradation compensator 16 will be given later with reference to FIG. 4.

According to some example embodiments, some or all of the degradation compensator 16 may be configured integrally with the timing controller 11. For example, some or all of the degradation compensator 16 may be configured in the form of an integrated circuit with the timing controller 11. According to some example embodiments, some or all of the degradation compensator 16 may be implemented in software in the timing controller 11. According to some example embodiments, the degradation compensator 16 may be implemented in software or hardware in an external processor.

The data driver 12 may generate data voltages to provide to data lines D1, D2, D3, and Dn using the output grayscale values and control signals. For example, the data driver 12 may sample the output grayscale values using a clock signal and apply data voltages corresponding to the output grayscale values to the data lines D1-Dn for each pixel row. The n may be an integer greater than zero.

The scan driver 13 may receive a clock signal and a scan start signal from the timing controller 11 and generate scan signals to be provided to the scan lines S1, S2, S3, and Sm. For example, the scan driver 13 may sequentially provide scan signals with a pulse of a turn-on level to the scan lines S1-Sm. For example, each scan stage circuit of the scan driver 13 may be configured in the form of a shift register, and generate scan signals in a manner that sequentially transmits the scan start signal with a pulse of turn-on level to the next scan stage circuit according to a control of a clock signal. The m may be an integer greater than zero.

The emission driver 14 may receive a clock signal, a emission stop signal, and the like from the timing controller 11 to generate emission signals to be provided to emission lines E1, E2, E3, and Eo. For example, the emission driver 14 may sequentially provide emission signals with a pulse of a turn-off level on the emission lines E1-Eo. For example, each emission stage circuit of the emission driver 14 may be configured in the form of a shift register, and generate emission signals in a manner that sequentially transmits the emission stop signal with a pulse of turn-on level to the next emission stage circuit according to a control of a clock signal. The o may be an integer greater than zero.

The pixel unit 15 includes pixels. Each pixel PXij may be connected to the corresponding data line, scan line and emission line. In addition, the pixels PXij may be connected to a common first power line and second power line being common to each other. The i and j may be natural numbers. The pixel PXij may refer to a pixel of which the scan transistor is connected to the i-th scan line and the j-th data line.

Figure 2:
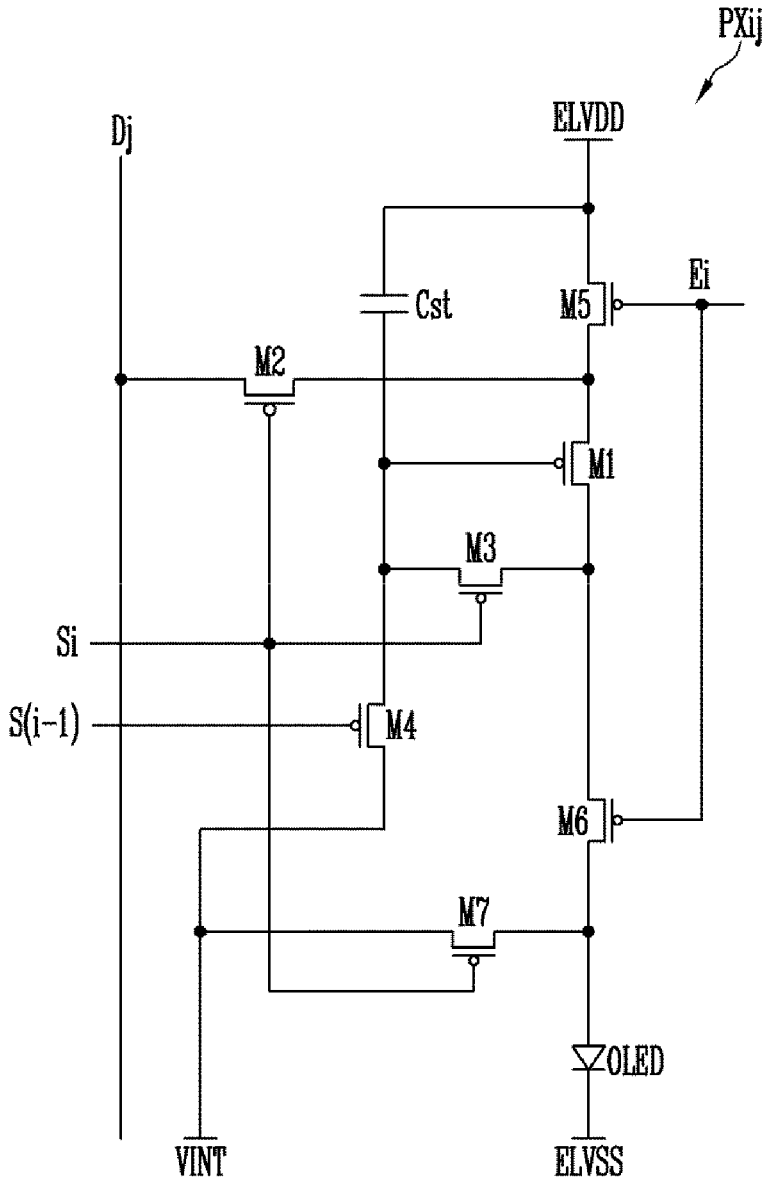
FIG. 2 is a drawing for illustrating a pixel according to some example embodiments of the present invention.

FIG. 2 is a drawing for illustrating a pixel according to some example embodiments of the present invention.

Referring to FIG. 2, the pixel PXij may include transistors M1, M2, M3, M4, M5, M6, and M7, a storage capacitor Cst, and an organic light emitting diode OLED.

According to some example embodiments of the present invention, transistors are shown as P-type transistors, but a person of an ordinary skill in the art may configure a pixel circuit with the same function as an N-type transistor. Hereinafter, it is assumed that the transistors are configured of p-type transistors.

A first electrode of the storage capacitor Cst may be connected to the first power line ELVDD and a second electrode of the storage capacitor Cst may be connected to a gate electrode of the transistor M1.

A first electrode of the transistor M1 may be connected to a second electrode of a transistor M5, a second electrode of the transistor M1 may be connected to a first electrode of the transistor M6, and a gate electrode of the transistor M1 may be connected to the second electrode of the storage capacitor Cst. The transistor M1 may be referred to as a driving transistor. The transistor M1 determines an amount of a pixel driving current flowing between a first power line ELVDD and a second power line ELVSS according to a potential difference between the gate electrode and a source electrode.

A first electrode of the transistor M2 may be connected to the data line Dj, a second electrode of the transistor M2 may be connected to the first electrode of the transistor M1, and a gate electrode of the transistor M2 may be connected to a current scan line Si. The transistor M2 may be referred to as a switching transistor, a scan transistor, and the like. The transistor M2 pulls and inputs a data voltage of the data line Dj to the pixel PXij when a scan signal of a turn-on level is applied to the current scan line Si.

A first electrode of the transistor M3 may be connected to the second electrode of transistor M1, a second electrode of transistor M3 may be connected to the gate electrode of transistor M1, and a gate electrode of transistor M3 may be connected to the current scan line Si. The transistor M3 connects the transistor M1 in a diode form when a scan signal of a turn-on level is applied to the current scan line Si.

A first electrode of the transistor M4 may be connected to the gate electrode of transistor M1, a second electrode of the transistor M4 may be connected to an initialization voltage line, and a gate electrode of the transistor M4 may be connected to a previous scan line S(i−1). According to some example embodiments, the gate electrode of the transistor M4 may be connected to another scan line. The transistor M4 transmits the initialization voltage VINT to the gate electrode of the transistor M1 when a scan signal of a turn-on level is applied to the previous scan line S(i−1), thereby initializing a charge amount of the gate electrode of the transistor M1.

A first electrode of the transistor M5 may be connected to the first power line ELVDD, a second electrode of the transistor M5 may be connected to the first electrode of transistor M1, and a gate electrode of the transistor M5 may be connected to a emission line Ei. A first electrode of the transistor M6 may be connected to the second electrode of transistor M1, a second electrode of the transistor M6 may be connected to an anode of the organic light emitting diode OLED, and a gate electrode of the transistor M6 may be connected to the emission line Ei. The transistors M5 and M6 may be referred to as a light emitting transistor. When a emission signal of a turn-on level is applied to the transistors M5 and M6, the transistors M5 and M6 form a path of a pixel driving current between the first power line ELVDD and the second power line ELVSS to light the organic light emitting diode OLED.

A first electrode of the transistor M7 may be connected to the anode of the organic light emitting diode OLED, a second electrode of the transistor M7 may be connected to the initialization voltage line, and a gate electrode of the transistor M7 may be connected to the current scan line Si. According to some example embodiments, the gate electrode of transistor M7 may be connected to another scan line. For example, the gate electrode of transistor M7 may be connected to the previous scan line S(i−1) or a scan line before the previous scan line, the next scan line (e.g., i−1-th scan line) or a scan line after the next scan line. The transistor M7 transmits the initialization voltage to the anode of the organic light emitting diode OLED when a scan signal of a turn-on level is applied to the current scan line Si, thereby initializing a charge amount stored in the organic light emitting diode OLED.

The anode of the organic light emitting diode OLED may be connected to the second electrode of the transistor M6 and the cathode of the organic light emitting diode OLED may be connected to the second power line ELVSS. The organic light emitting diode OLED is taken as an example embodiment of the present invention, but a degradable inorganic light emitting diode, a quantum dot light emitting diode, or the like may be provided in the pixel PXij in another example embodiment.

Figure 3:
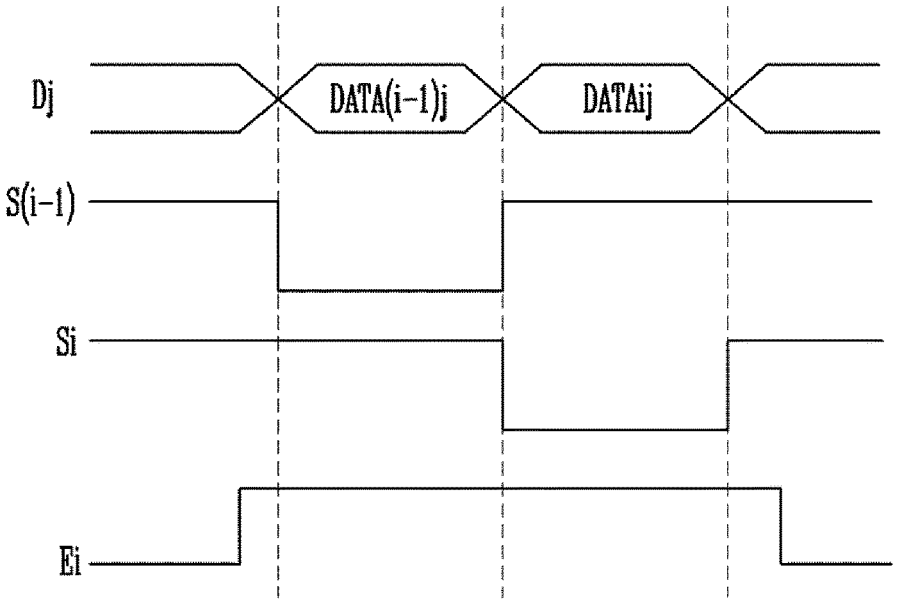
FIG. 3 is a drawing for illustrating a driving method of a pixel shown in FIG. 2.

FIG. 3 is a drawing for illustrating a driving method of a pixel shown in FIG. 2.

First, a data voltage DATA (i−1)j for a previous pixel row is applied to the data line Dj and a scan signal of a turn-on level (e.g., a low level) is applied to a previous scan line S(i−1).

Because a scan signal of a turn-off level is applied to the current scan line Si, the transistor M2 is in a turn-off state, and the data voltage DATA (i−1)j for the previous pixel row is prevented from being pulled and input into the pixel PXij.

At this time, because the transistor M4 is turned on, the initializing voltage is applied to the gate electrode of the transistor M1 to initialize the charge amount. Because a emission signal of a turn-off level is applied to the emission line Ei, the transistors M5 and M6 are turned off and a light emission of an unnecessary organic light emitting diode OLED according to an application process of the initialization voltage is prevented.

Next, a data voltage DATAij for a current pixel row is applied to the data line Dj, and a scan signal of a turn-on level is applied to the current scan line Si. As a result, the transistors M2, M1, and M3 are turned on, and the data line Dj and the gate electrode of the transistor M1 are electrically connected. Therefore, a compensation voltage that subtracts the threshold voltage of the transistor M1 from the data voltage DATAij is applied to the second electrode of the storage capacitor Cst, and the storage capacitor Cst stores a difference between a voltage of the first power line ELVDD and the compensation voltage.

At this time, because the transistor M7 is turned on, the anode of the organic light emitting diode OLED is connected to an initialization voltage line, and the organic light emitting diode OLED is precharged or initialized with a charge amount corresponding to a voltage difference between the initialization voltage and a voltage of the second power line.

Thereafter, as a emission signal of a turn-on level is applied to the emission line Ei, the transistors M5 and M6 are turned on and an amount of a pixel driving current flowing the transistor M1 is controlled according to a charge amount stored in the storage capacitor Cst so that a pixel driving current flows to the organic light emitting diode OLED. The organic light emitting diode OLED emits light until a emission signal of a turn-off level is applied to the emission line Ei.

Figure 4:
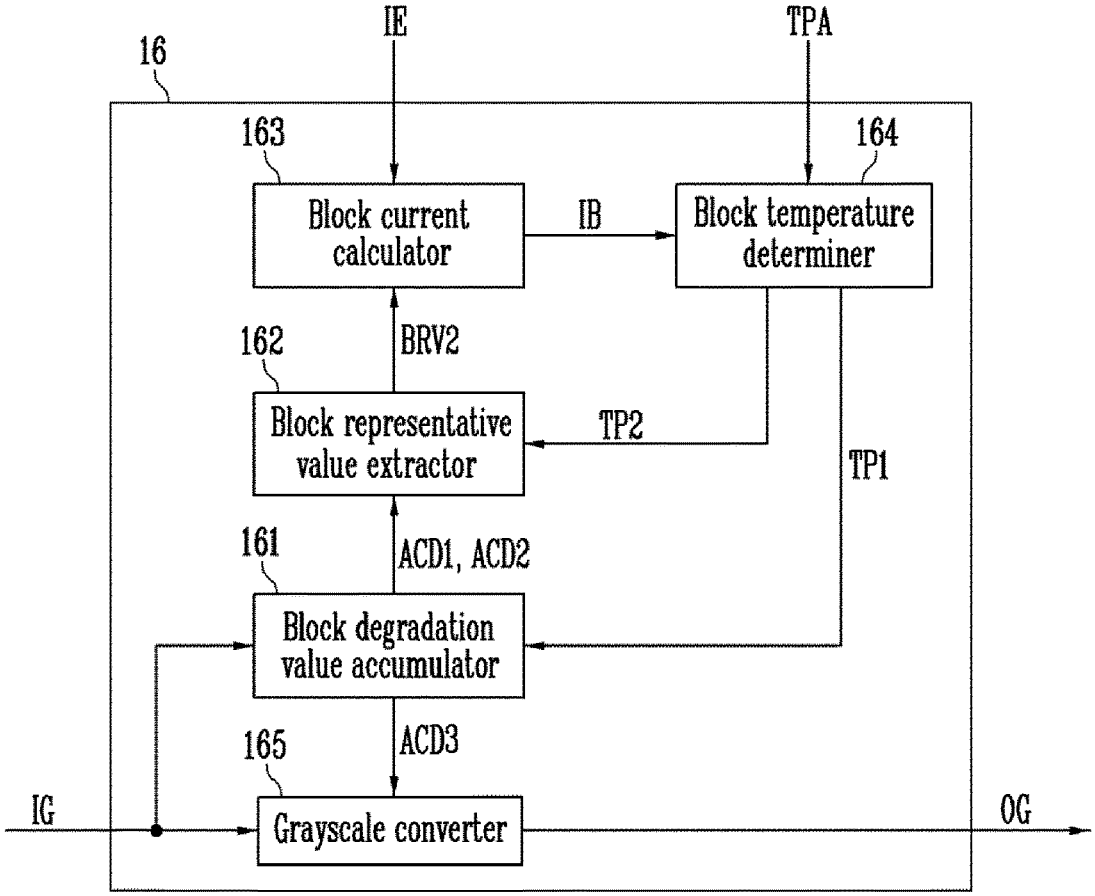
FIG. 4 is a drawing for illustrating a degradation compensator according to some example embodiments of the present invention.
Figure 5:
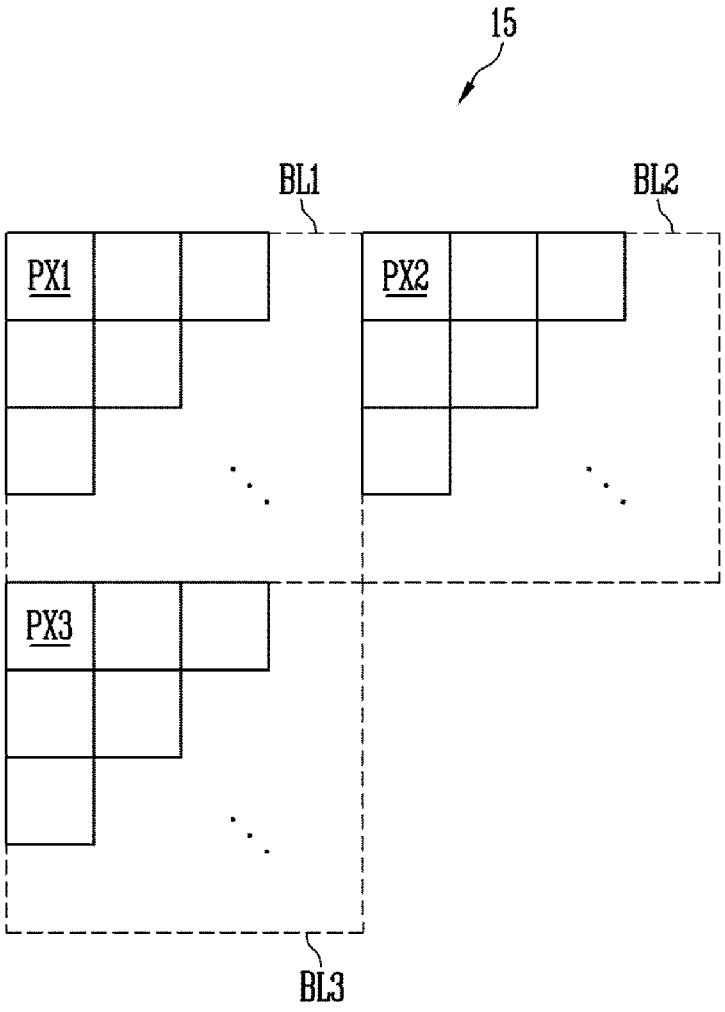
FIG. 5 is a drawing for illustrating a case where pixels are set into blocks according to some example embodiments.
Figure 6:
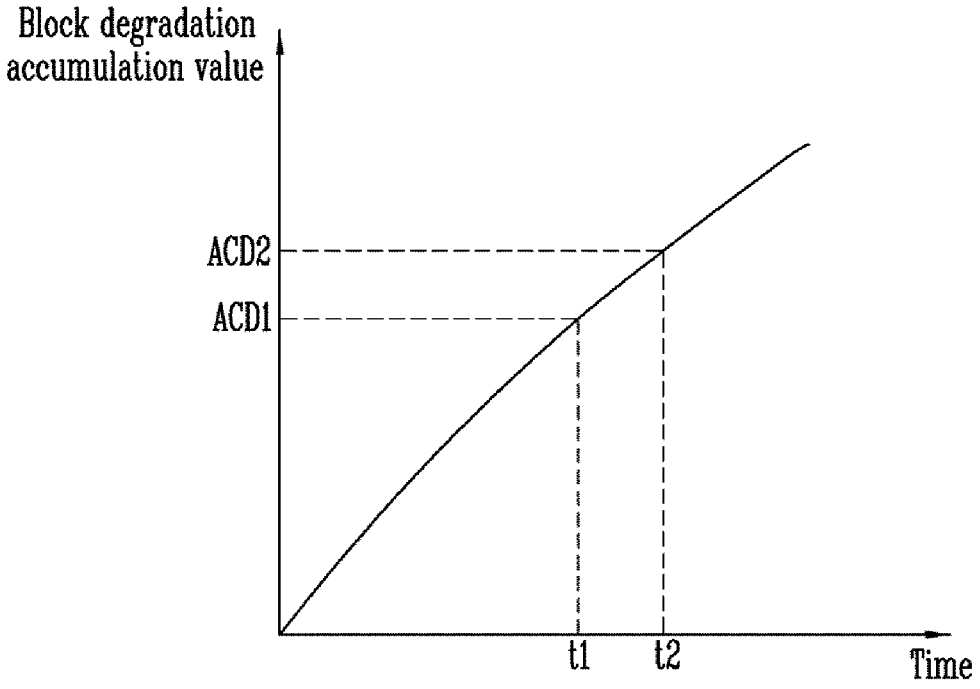
FIG. 6 is a drawing for illustrating an operation of a block representative value extractor according to some example embodiments.
Figure 7:
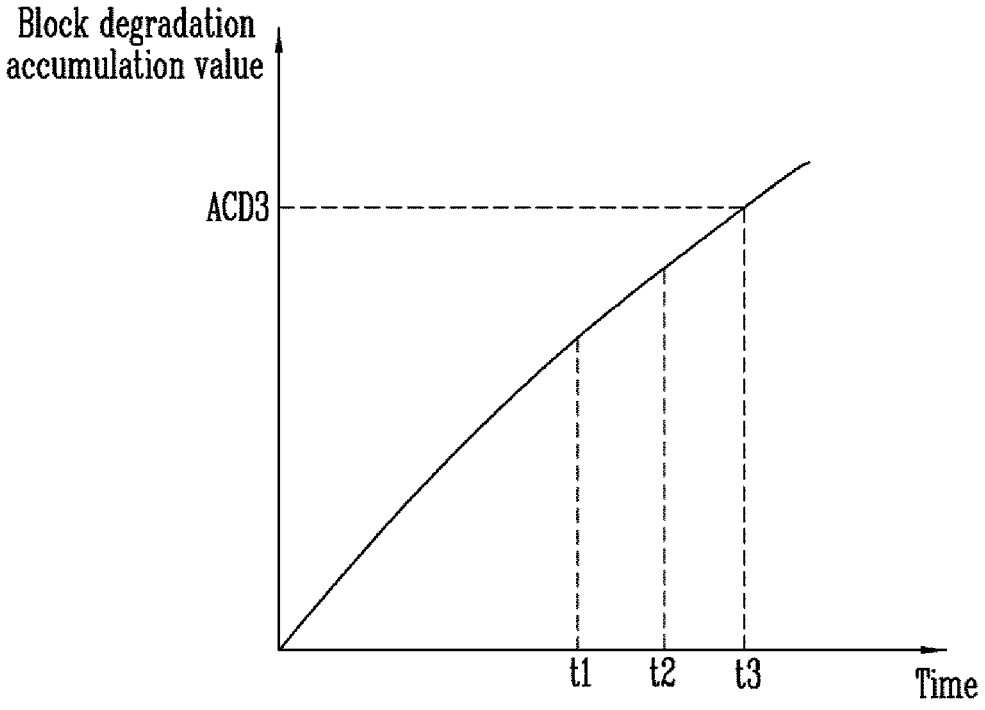
FIG. 7 is a drawing for illustrating an operation of a block degradation value accumulator according to some example embodiments.
Figure 8:
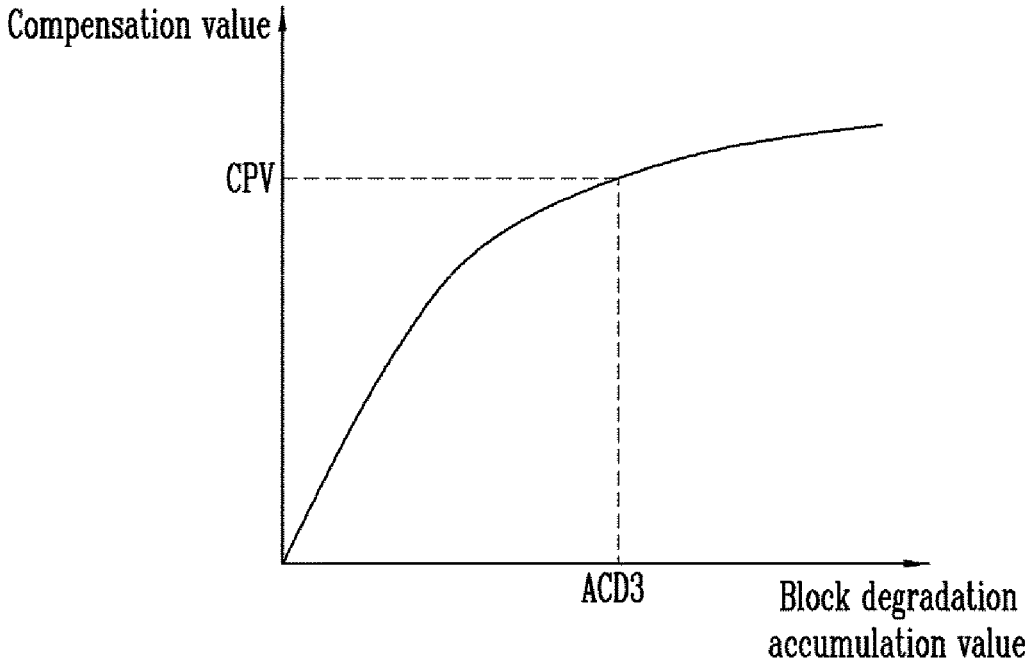
FIG. 8 is a drawing for illustrating an operation of a grayscale converter according to some example embodiments.

FIG. 4 is a drawing for illustrating a degradation compensator according to some example embodiments of the present invention, FIG. 5 is a drawing for illustrating a case where pixels are set into blocks, FIG. 6 is a drawing for illustrating an operation of a block representative value extractor, FIG. 7 is a drawing for illustrating an operation of a block degradation value accumulator, and FIG. 8 is a drawing for illustrating an operation of a grayscale converter.

Referring to FIG. 4, the degradation compensator 16 according to some example embodiments of the present invention may generate output grayscale values OG for the pixels PXij based on an entire driving current IE, an ambient temperature TPA, and input grayscale values IG for the pixels PXij.

For example, the degradation compensator 16 may include a block degradation value accumulator 161, a block representative value extractor 162, a block current calculator 163, a block temperature determiner 164, and a grayscale converter 165.

Referring to FIG. 5, pixels PX1, PX2, and PX3 may be set or partitioned into blocks BL1, BL2, and BL3. The number of blocks BL1, BL2, and BL3 may be less than or equal to the number of pixels PX1, PX2, and PX3. For example, each of blocks BL1, BL2, and BL3 may be set or partitioned to include one or more pixels PX1, PX2, and PX3. When each of blocks BL1, BL2, and BL3 includes only one of the pixels PX1, PX2, and PX3, that is, the number of blocks BL1, BL2, and BL3 is equal to the number of pixels PX1, PX2, and PX3, accurate degradation compensation may be achieved, but costs for a data storage and a computation may increase. When each of blocks BL1, BL2, and BL3 includes two or more of the pixels PX1, PX2, and PX3, that is, the number of blocks BL1, BL2, and BL3 is less than the number of pixels PX1, PX2, and PX3, costs for a data storage and computation decrease, but accurate degradation compensation may not be achieved. A manufacturer of the display device DD may determine a size of the blocks BL1, BL2, and BL3 in view of this trade-off relationship.

The block degradation value accumulator 161 may accumulate block degradation values based on input grayscale values IG and a first block temperature TP1 for each of blocks BL1, BL2, and BL3 to generate a block degradation accumulation value.

For example, the block degradation value accumulator 161 may update the block degradation accumulation value by multiplying a first block representative value of the input grayscale values IG and a first block temperature TP1 to generate a block degradation value and adding the generated block degradation value to a block degradation accumulation value for each of the blocks BL1, BL2, and BL3 (see Equation 1).

$$ACD(n)=ACD[n-1]+BRV1[n]*TP1 \quad \text{[Equation 1]}$$

Here, ACD [n−1] may be a block degradation accumulation value up to the n−1-th image frame, BRV1 [n] may be a first block representative value in the n-th image frame, and TP1 may be a first block temperature TP1. ACD [n] may be a block degradation accumulation value up to the n-th image frame.

For example, the first block representative value may be a value obtained by applying weight values to the input grayscale values IG of the corresponding block and dividing by the number of the input grayscale values IG. For example, when weight values of the input grayscale values IG are equal to 1, a representative value may mean an average value.

In Equation 1, BRV1 [n]*TP1 may be a block degradation value. That is, the larger the first block representative value BRV1 [n] in the n-th image frame and the larger the first block temperature TP1, the larger the block degradation value in the n-th image frame. The block degradation value may correspond to the degree of degradation of the organic light emitting diodes included in the pixels included in the corresponding block. When an organic light emitting diode is degraded, more driving current is required to emit light at the same level of luminance.

Because the block degradation value accumulator 161 must store degradation data over an entire life-span of the display device DD, degradation data needs to be simplified. For example, the block degradation value accumulator 161 may store a block degradation accumulation value at the current time, and may not store a block degradation accumulation value at the past time, the first block representative value of each image frame, and the first block temperature TP1.

As shown in FIG. 6, the block degradation accumulation value increases with time.

The block representative value extractor 162 may extract a second block representative value BRV2 based on a first block degradation accumulation value ACD1 which is the block degradation accumulation value at a first time t1, a second block degradation accumulation value ACD2 which is the block degradation accumulation value at a second time t2, and a second block temperature TP2 for each of the blocks BL1, BL2, and BL3.

For example, the block representative value extractor 162 may generate the second block representative value BRV2 by dividing a difference between the second block degradation accumulation value ACD2 and the first block degradation accumulation value ACD1 by the second block temperature TP2 to for each of the blocks BL1, BL2, and BL3 (See Equation 2).

$$BRV2=(ACD2(t2)-ACD1(t1))/TP2 \quad \text{[Equation 2]}$$

Here, BRV2 may be the second block representative value, ACD2 (t2) may be the second block degradation accumulation value at the second time t2, ACD1 (t1) may be the first block degradation accumulation value at the first time t1, and TP2 may be the second block temperature TP2.

If the block degradation value of the n-th image frame is reflected in the block degradation accumulation value at the second time t2, the block degradation value of the n−1-th image frame is reflected in the block degradation accumulation value at the first time t1, and the second block temperature TP2 is equal to the first block temperature TP1 in Equation 1, BRV2 in Equation 2 becomes equal to BRV1 [n] in Equation 1. That is, according to some example embodiments, the block representative value extractor 162 may accurately extract the block representative value from the block degradation value accumulator 161 including only information on the block degradation accumulation value.

However, according to the specification of a product, the block degradation value of the n-th image frame may be reflected in the block degradation accumulation value at the second time t2, and the block degradation value of the n−2-th image frame may be reflected in the block degradation accumulation value at the first time t1 or a time before the first time t1. That is, an interval with which the block representative value extractor 162 samples the block degradation accumulation value from the block degradation value accumulator 161 may be more than an interval of two image frame. In this case, the second block representative value BRV2 may be mismatched with the first block representative value BRV1 [n] of Equation 1, but the display device DD may be designed so that this mismatch may be acceptable for calculating the block temperature.

The block current calculator 163 may calculate a block current IB based on the entire driving current IE, the second block representative value BRV2 and the entire block representative value for each block BL1, BL2, and BL3.

For example, the block current calculator 163 calculates the block current IB so that a ratio of the block current IB of the entire driving current IE may correspond to a ratio of the second block representative value BRV2 of the entire block representative value for each blocks BL1, BL2, and BL3.

$$IB=IE*(BRV2/EBRV) \quad \text{[Equation 3]}$$

Here, IB is the block current, IE is the entire driving current, BRV2 is the second block representative value, and EBRV is the entire block representative value.

As described above, the entire driving current IE may refer to the entire current flowing from the first power line ELVDD to the second power line ELVSS in the pixel unit 15. The pixels PXij may be connected to the first power line ELVDD and the second power line ELVSS to be common to each other.

In addition, as described above, when the current sensor 17 cannot be disposed to directly measure the entire current flowing from the first power line ELVDD to the second power line ELVSS, the current sensor 17 may be disposed to measure a current provided to the pixel unit 15 or a current provided to the entire display panel 10. In this case, the measured entire driving current IE may be mismatched with the entire driving current IE of Equation 3, but the display device DD may be designed so that this mismatch may be acceptable for calculating the block current. For example, the entire driving current IE may be obtained by excluding a current amount that is expected to be consumed from another element except for the pixel unit 15 from the measured current value.

In addition, when the interval with which the block representative value extractor 162 samples the block degradation accumulation value from the block degradation value accumulator 161 may more than an interval of two image frame as described above, the entire driving current IE may be a value accumulated more than an interval of two image frame.

An entire block representative value may be a value obtained by adding weight values to the second block representative values of the entire blocks BL1, BL2, and BL3. For example, when the weight values are all 1, the entire block representative value may be a sum of the second block representative values of the second blocks of BL1, BL2, and BL3.

The block temperature determiner 164 may determine a first block temperature TP1 based on a block current IB and an ambient temperature TPA for each of blocks BL1, BL2, and BL3.

For example, the block temperature determiner 164 may determine the first block temperature TP1 by adding a value which is proportional to a difference between a block predicted temperature for the block current IB and an ambient temperature TPA to the ambient temperature TPA for each block BL1, BL2, and BL3 (see Equation 4).

$$TP1=TPA+(K*(TPE-TPA)) \quad \text{[Equation 4]}$$

Here, TP1 is the determined first block temperature TP1, TPA is the ambient temperature TPA, K is a proportional constant, and TPE is the block predicted temperature.

The block prediction temperature TPE may be determined by referring to a look up table LUT based on the block current IB. Alternatively, the block prediction temperature TPE may be determined by another algorithms.

Different block currents IB may flow and the first block temperature TP1 may be changed depending on a luminous efficiency of the display panel 10 even with the same input grayscale values IG. Therefore, the accurate first block temperature TP1 can be obtained by referring to the block current IB as well as the input grayscale values IG according to some example embodiments of the present invention.

In addition, some example embodiments of the present invention may be implemented with only one current sensor 17 and one temperature sensor 18.

The block degradation value accumulator 161 may update the third block degradation accumulation value ACD3 at the third time t3 by adding the block degradation value to the second block degradation accumulation value ACD2 at the second time t2 through Equation 1.

The grayscale converter 165 may convert the input grayscale values IG to the output grayscale values OG based on a third block degradation accumulation value ACD3.

For example, the grayscale converter 165 may generate the output grayscale values OG by adding compensation values CPV to the input grayscale values IG. The compensation values CPV may be larger as the corresponding third block degradation accumulation value ACD3 is larger. In other words, the degradation of an organic light emitting diode OLED may be compensated by adding a larger compensation value CPV to the input grayscale value IG.

The drawing and the detailed description of the present invention referred to above are descriptive sense only and are used for the purpose of illustration only and are not intended to limit the meaning thereof or to limit the scope of the invention described in the claims. Accordingly, a person having ordinary skill in the art will understand from the above that various modifications and other equivalent embodiments are also possible. Therefore, the real protective scope of the present invention shall be determined by the technical scope of the accompanying claims, and their equivalents.

What is claimed is:

1. A display device comprising:

a display panel including a plurality of pixels configured to receive pixel driving currents;

a current sensor configured to measure an entire driving current diverged into the pixel driving currents; and a temperature sensor configured to measure an ambient temperature of the display panel, wherein the display panel includes a degradation compensator configured to generate output grayscale values for the pixels based on the entire driving current, the ambient temperature, and input grayscale values for the pixels, wherein the pixels are set into blocks, wherein a number of the blocks is less than or equal to a number of the pixels, and wherein the degradation compensator includes:

a block representative value extractor configured to extract a second block representative value based on a first block degradation accumulation value, which is a block degradation accumulation value at a first time, a second block degradation accumulation value, which is the block degradation accumulation value at a second time, and a second block temperature, for each of the blocks.

2. The display device of claim 1, wherein the degradation compensator further includes:

a block degradation value accumulator configured to accumulate a block degradation value based on the input grayscale values and a first block temperature to generate the block degradation accumulation value, for each of the blocks.

3. The display device of claim 2, wherein the block degradation value accumulator is configured to update the block degradation accumulation value by multiplying a first block representative value corresponding to the input grayscale values and the first block temperature to generate the block degradation value and adding the generated block degradation value to the block degradation accumulation value, for each of the blocks, and wherein the first block representative value is obtained by applying weight values to the input grayscale values of a corresponding block and dividing by a number of the input grayscale values.

4. The display device of claim 1, wherein the block representative value extractor is configured to divide a difference between the second block degradation accumulation value and the first block degradation accumulation value by the second block temperature to generate the second block representative value, for each of the blocks.

5. The display device of claim 1, wherein the degradation compensator further includes:

a block current calculator configured to calculate a block current based on the entire driving current, the second block representative value, and an entire block representative value, for each of the blocks.

6. The display device of claim 5, wherein the block current calculator is configured to calculate the block current so that a ratio of the block current of the entire driving current corresponds to a ratio of the second block representative value of the entire block representative value, for each of the blocks.

7. The display device of claim 5, wherein the degradation compensator further includes:

a block temperature determiner configured to determine a first block temperature based on the block current and the ambient temperature, for each of the blocks.

8. The display device of claim 7, wherein the block temperature determiner is configured to determine the first block temperature by adding a value proportional to a difference between a block predicted temperature for the block current and the ambient temperature to the ambient temperature, for each block.

9. The display device of claim 7, wherein the degradation compensator further includes:

a grayscale converter configured to convert the input grayscale values to the output grayscale values based on the block degradation accumulation value.

10. The display device of claim 9, wherein the grayscale converter is configured to generate the output grayscale values by adding compensation values to the input grayscale values, and wherein the compensation values are larger as the block degradation accumulation value corresponding to the compensation values is larger.

11. A driving method of a display device comprising:

measuring a current corresponding to an entire driving current provided to a display panel and diverged into pixel driving currents;

measuring a temperature corresponding to an ambient temperature of the display panel; and compensating a degradation by generating output grayscale values for a plurality of pixels based on the entire driving current, the ambient temperature, and input grayscale values for the pixels, wherein the pixels are set into blocks, wherein a number of the blocks is less than or equal to a number of the pixels, wherein the compensating the degradation includes:

extracting a block representative value that extracts a second block representative value based on a first block degradation accumulation value, which is a block degradation accumulation value at a first time, a second block degradation accumulation value, which is the block degradation accumulation value at a second time, and a second block temperature, for each of the blocks.

12. The driving method of claim 11, wherein the compensating the degradation further includes:

accumulating a block degradation value based on the input grayscale values and a first block temperature to generate the block degradation accumulation value, for each of the blocks, wherein, in the accumulating the block degradation value, the block degradation value is generated by multiplying a first block representative value corresponding to the input grayscale values and the first block temperature, and the block degradation accumulation value is updated by adding the generated block degradation value to the block degradation accumulation value, for each of the blocks, and wherein the first block representative value is obtained by applying weight values to the input grayscale values of a corresponding block and dividing by a number of the input grayscale values.

13. The driving method of claim 12, wherein, in the extracting the block representative value, the second block representative value is generated by dividing a difference between the second block degradation accumulation value and the first block degradation accumulation value by the second block temperature, for each of the blocks.

14. The driving method of claim 13, wherein the compensating the degradation further includes:

calculating a block current that calculates a block current based on the entire driving current, the second block representative value, and an entire block representative value, for each of the blocks.

15. The driving method of claim 14, wherein, in the calculating the block current, the block current is calculated so that a ratio of the block current of the entire driving current corresponds to a ratio of the second block representative value of the entire block representative value, for each of the blocks.

16. The driving method of claim 14, wherein the compensating the degradation further includes:

determining a block temperature that determines the first block temperature based on the block current and the ambient temperature, for each of the blocks.

17. The driving method of claim 16, wherein, in the determining the block temperature, the first block temperature is determined by adding a value proportional to a difference between a block predicted temperature for the block current and the ambient temperature to the ambient temperature, for each block.

18. The driving method of claim 16, wherein the compensating the degradation further includes:

converting a grayscale that converts the input grayscale values to the output grayscale values based on the block degradation accumulation value.

19. The driving method of claim 18, wherein, in the converting the grayscale, the output grayscale values are generated by adding compensation values to the input grayscale values, and wherein the compensation values are larger as the block degradation accumulation value corresponding to the compensation values is larger.

* * * * *